US010667348B2

(12) United States Patent
Radermacher et al.

(10) Patent No.: US 10,667,348 B2
(45) Date of Patent: May 26, 2020

(54) LIGHTING DEVICE AND LIGHTING SYSTEM FOR BALLAST TYPE DETECTION AND METHOD OF PROVIDING MAINTENANCE INFORMATION

(71) Applicant: SIGNIFY HOLDING B.V., Eindhoven (NL)

(72) Inventors: Harald Josef Günther Radermacher, Eindhoven (NL); Peter Deixler, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/475,189

(22) PCT Filed: Dec. 18, 2017

(86) PCT No.: PCT/EP2017/083259
§ 371 (c)(1),
(2) Date: Jul. 1, 2019

(87) PCT Pub. No.: WO2018/127392
PCT Pub. Date: Jul. 12, 2018

(65) Prior Publication Data

US 2019/0342958 A1 Nov. 7, 2019

(30) Foreign Application Priority Data

Jan. 4, 2017 (EP) ..... 17150230

(51) Int. Cl.
*H05B 33/00* (2006.01)
*H05B 45/00* (2020.01)
(Continued)

(52) U.S. Cl.
CPC ..... *H05B 45/00* (2020.01); *H05B 45/50* (2020.01); *H05B 47/19* (2020.01)

(58) Field of Classification Search
CPC ..... H05B 37/0272; H05B 37/0227; H05B 37/0281; H05B 33/0854; H05B 33/0872;
(Continued)

(56) References Cited

U.S. PATENT DOCUMENTS

2011/0121654 A1* 5/2011 Recker ..... H02J 9/065 307/66
2011/0266345 A1 11/2011 Fowler et al.
(Continued)

FOREIGN PATENT DOCUMENTS

WO 2018077693 A1 5/2018

*Primary Examiner* — Monica C King
(74) *Attorney, Agent, or Firm* — Akarsh P. Belagodu

(57) ABSTRACT

A lighting device (6) comprising a light emitting diode module (8), arranged for being installed in a lighting fixture (1), and for receiving power from a ballast (3) accommodated in the lighting fixture (1). The lighting device (6) has a ballast type detection circuit (12), for determining ballast type detection data from power signals supplied by the ballast (3), and a communication circuit (13), operatively connected to the ballast type detection circuit (12), for exchanging the ballast type detection data, among others for providing maintenance information and for operation of the lighting device (6) in a lighting system.

14 Claims, 3 Drawing Sheets

(51) Int. Cl.
*H05B 45/50* (2020.01)
*H05B 47/19* (2020.01)

(58) Field of Classification Search
CPC ..... H05B 33/0809; H05B 33/0803; H05B 33/0845; H05B 37/0218; H05B 33/0842; H05B 33/0857; H05B 33/089
See application file for complete search history.

(56) References Cited

U.S. PATENT DOCUMENTS

| | | | |
|---|---|---|---|
| 2012/0229040 | A1 | 9/2012 | Brown et al. |
| 2013/0221867 | A1 | 8/2013 | Deppe et al. |
| 2013/0320869 | A1 | 12/2013 | Jans et al. |
| 2013/0342119 | A1 | 12/2013 | Malboeuf Joset et al. |
| 2016/0165687 | A1 | 6/2016 | Hong |

* cited by examiner

LIGHTING DEVICE AND LIGHTING SYSTEM FOR BALLAST TYPE DETECTION AND METHOD OF PROVIDING MAINTENANCE INFORMATION

CROSS-REFERENCE TO PRIOR APPLICATIONS

This application is the U.S. National Phase application under 35 U.S.C. § 371 of International Application No. PCT/EP2017/083259, filed on Dec. 18, 2017, which claims the benefit of European Patent Application No. 17150230.5, filed on Jan. 4, 2017. These applications are hereby incorporated by reference herein.

FIELD OF THE INVENTION

The present invention generally relates to the field of lighting and, more particularly, to a solid-state lighting device for being powered by a ballast from a mains power supply, such as a retrofit tube type or bulb type Light Emitting Diode, LED, lighting device. The present invention further relates to a lighting system comprised of such lighting devices and a method of providing maintenance information.

BACKGROUND OF THE INVENTION

Amongst others, due to their long lifetime and high energy efficiency, solid state LED sources are swiftly replacing traditional incandescent bulb and fluorescent Tube Light, TL, lamps in both private and industrial lighting applications, including warehouses, shops, stores, schools, factories and the like. To take advantage of solid state lighting in traditional lighting applications and systems, so-called solid-state or LED retrofit lighting devices are provided. A solid-state retrofit lamp is typically adapted to fit into the socket of a traditional lamp fixture to be retrofitted. In practice, LED retrofit lighting devices are available for readily any type of traditional or legacy fixture.

Present building lighting management systems, BMS, necessitate a transition of traditional lighting systems comprised of isolated lighting devices or groups of lighting devices, commonly operated by a single switch or switching device, into intelligent, networked and communicatively connected lighting systems.

For an economical replacement of traditional light sources by LED lamps or LED lighting modules on a large scale, dedicated luminaire such as TL luminaires or fixtures, for example, need to be modified as less as possible.

In practice, this means that the wiring and control circuits, such as an electromagnetic, EM, ballast in a fluorescent lighting fixture are not to be removed or altered, and that just the tube lamp or bulb is to be replaced by a solid state retrofit lighting device.

For a proper operation and light management of retrofit light sources, plural system parameters are required, among which the type of ballast already installed in a legacy luminaire or fixture, for example.

Determining the type of ballast via manual inspection of each luminaire is economically hardly feasible, or may even not be possible because the luminaire housing cannot be opened without breaking seals or impacting a safety label or the like.

Published United States patent application US2013/0320869 discloses a light emitting diode tube lamp, TLED, arranged for detecting the type of EM ballast, from electrical current measurements performed and evaluated by a ballast type detection algorithm implemented in a processor controlled driver integrated in the housing of the TLED lamp.

Published United States patent application US2016/0165687 discloses a ballast type detecting circuit from frequency measurements.

Both prior art applications are arranged to control the supply voltage in a particular luminaire for operating a retrofit LED light source or lamp in accordance with the detected type of ballast.

Cost efficient maintenance and high reliability are key performance indicators in industrial lighting systems. In case of malfunctioning of a ballast, for example, for efficient and quick repair and to keep the costs of spare parts as low as possible, service personnel should be informed in advance of the type of ballast installed in a particular luminaire. In particular when a selected type of LED light source or lamp is installed adapted to a particular type of ballast or when plural LED light sources or modules connect to a common ballast, for example.

SUMMARY OF THE INVENTION

It is an object of the present disclosure to provide for an improved lighting management for retrofit legacy luminaires or fixtures comprising a ballast, in particular for improved maintenance and servicing purposes of such retrofit luminaires or fixtures in an industrial lighting system, for example.

In a first aspect there is provided a lighting device comprising a connector arranged for being installed in a lighting fixture comprising a ballast for powering the lighting device, the lighting device comprising:

- a light emitting diode module;
- a driver circuit, operatively connected between the connector and the light emitting diode module, arranged for controlling supply of power to the light emitting diode module;
- a ballast type detection circuit, operatively connected to the connector, arranged for determining ballast type detection data from power signals supplied by the ballast to the connector, and
- a communication circuit, operatively connected to the ballast type detection circuit, arranged for exchanging the ballast type detection data.

The lighting device proposed is arranged to communicate determined ballast type detection data, such that same can be used for other purposes than controlling or operating the driver circuit for powering the light emitting diode, LED, module according to the prior art disclosed in the summary section above.

Being able to exchange ballast type detection data or information, the lighting device proposed effectively supports commissioning of a lighting system, lighting system asset management and lighting system maintenance in retrofitting applications of legacy fluorescent lamp type luminaire or fixtures.

The data exchanged may also be used for choosing a suitable lighting device to replace a fluorescent device present in the lighting fixture. As such, in a first step the proposed lighting device is inserted in the lighting device to determine, and indicate, which ballast is present in the lighting fixture. In a second step, this information is used to choose a suitable retrofit lighting device to be fitted in the lighting fixture. A suitable retrofit lighting device, in accordance with the present disclosure, is a device which is tailored to the detected ballast in the lighting fixture.

In an embodiment of the lighting device, the communication circuit is arranged for exchanging the ballast type detection data with a ballast type data base of a lighting system. The data provided may be captured in the data base and provided for further analysis, for example.

The main purpose of a ballast is to supply power to the fluorescent lamp powered thereby. In practice, several types of ballast are used, such as radio frequency, RF, operated electronic or self-resonating ballasts, integrated circuit, IC, controlled resonating ballasts, electromagnetic, EM, ballasts, and others, each with their own specific operational parameters, typical functional characteristics and electrical signal values.

In an embodiment of the lighting device, the ballast type detection circuit is arranged for providing ballast type detection data from at least one of:

- power supply frequency monitoring of a self-resonating radio frequency electronic ballast;
- power supply resonant tank probing monitoring of a self-resonating radio frequency electronic ballast;
- control parameter monitoring of a control circuit of a resonance controlled radio frequency electronic ballast, and
- power supply voltage and current monitoring at the connector of the lighting device.

As will be appreciated by those skilled in the art, the information regarding the type of ballast is present in and extracted from the electric signals provided by a particular ballast in a particular operation mode thereof.

In addition to the thus determined ballast type detection data, auxiliary data may be provided and used for determining the type of ballast. Such as, but not limited to, the length an/or diameter of a tube lamp for retrofit, the number of luminaires or fixtures powered from a common ballast, such as two (duo), three (triple) or four (quad) lighting devices, data captured from data sheets, and the like.

To this end, in an embodiment of the lighting device, the ballast type detection circuit and the communication circuit are arranged for exchanging auxiliary data in support of the ballast type detection data.

In an other embodiment of the lighting device, the communication circuit is arranged for wirelessly exchanging at least one of the ballast type detection data and auxiliary data.

To this end, the communication circuit may comprise a transmitter, or even a transceiver, operated in accordance with a standardized or proprietary data communication and signalling protocol. In practice, wireless radio transmission technologies available for the purpose of the present disclosure are, inter alia, ZigBee™ Light Link, Bluetooth™, and WiFi based protocols or any Mesh type of wireless network.

In an embodiment of the lighting device, the ballast type detection circuit is arranged for automatically establishing a type of ballast from at least one of the ballast type detection data and the auxiliary data. That is, the ballast type detection circuit comprises a processor, such as a microprocessor or microcontroller, for example, equipped with suitable intelligence, i.e. a software algorithm or algorithms, for analysing the available ballast type detection data and/or auxiliary data, for determining the type of ballast by which the lighting device is powered.

Although this embodiment requires on-board intelligence, among others a database for storing ballast type data, the thus determined information of the ballast type can be directly used for proper control of the driver circuit for powering the LED module, for example. This embodiment also will result in a low communication effort.

In an other embodiment of the lighting device, the ballast type detection circuit and the communication circuit are arranged for exchanging the ballast type detection data on at least one of an event driven and time driven basis.

By regularly determining and exchanging ballast type detection data from the ballast type detection circuit, such as based on a time or event driven basis, for example once a day, or once per hour, or the like, or when the lighting device is switched on, the ballast type detection data can be advantageously used for maintenance purposes.

That is, if a lighting device does not exchange data, for example, or data pointing to a different type of ballast, this may be a genuine indication of malfunctioning of, for example, the ballast. As the type of ballast is previously established, service or maintenance personnel is directly informed of the correct type of ballast to be serviced.

In a second aspect there is provided a lighting system, comprising at least one lighting device disclosed above, mounted in a fixture or luminaire, a communication unit arranged for exchanging ballast type detection data with a communication circuit of the at least one lighting device and comprising a ballast type data base.

Each lighting device may be individually addressable, such that respective ballast type detection data and/or auxiliary data, as elucidated above, can be uniquely stored in a ballast type data base of the lighting system, or in a data base relating to plural lighting system, for example. It will be appreciated that the communication unit of the lighting system, i.e. the transceiver thereof, operates with a same proprietary or standardized communication and signalling protocol as the communication circuit of a lighting device disclosed above.

It is noted that for retrofit applications, not all of the light sources or lamps of a traditional lighting system need to be equipped with a lighting device according to the present disclosure. For establishing the type of ballast, it is sufficient to equip just one legacy luminaire or fixture of a plurality of identical luminaires or fixtures with a lighting device disclosed, for example.

The lighting device may serve as a kind of test device. That is, once the type of ballast is established by the lighting device in accordance with the present disclosure, all other identical luminaires or fixtures in a lighting system may be equipped with retrofit lighting devices particularly adapted to the thus established ballast, thereby saving costs in the purchase of lighting devices and in stock control, for example.

In an embodiment, the ballast type data base may comprise auxiliary data in support of the ballast type detection data as disclosed above, while the communication module nay be arranged for exchanging the auxiliary data with the communication circuit of the at least one lighting device.

Instead of or in addition to the determination of the type of ballast by the ballast type detection circuit of the lighting device, in an embodiment the lighting system comprises a ballast type detection unit, operatively connected to the ballast type data base, and arranged for establishing a type of ballast of the lighting device from the exchanged ballast type detection data and the auxiliary data.

The ballast type detection unit is arranged for automatically establishing a type of ballast from at least one of the ballast type detection data and the auxiliary data. To this end the ballast type detection circuit may comprise a processor, such as a microprocessor or microcontroller, for example, equipped with suitable intelligence, i.e. a software algorithm or algorithms, for analysing the available ballast type detection data and/or auxiliary data, for determining the type of ballast by which the lighting device is powered.

In this scenario, the ballast type detection circuit of the lighting device does not require intelligence to establish the type of ballast. Data collected by the ballast type detection circuit may be directly exchanged, without any pre-processing or the like, with the ballast type detection unit where the type of ballast is eventually established and processed.

In an intermediate mode of operation, the ballast type detection circuit of the lighting device may be arranged for pre-processing of measured data, for example by calculating mean values or signal variation values, for example, which are then exchanged with the ballast type detection unit of the lighting system for further processing and determining of the type of ballast. It will be appreciated that this intermediate solution will require less communication effort than the scenario in which the ballast type detection circuit thus not provide any type of data pre-processing.

The lighting system further may comprise a maintenance unit, arranged for receiving ballast type detection data of the at least one lighting device provided on at least one of an event driven and time driven basis, for analysing malfunctioning of a ballast based on the received ballast type detection data.

As discussed above, the ballast type detection data may be advantageously processed for identifying malfunctioning or breakdown of a lighting device. In case of malfunctioning, from the information stored in the ballast type data base service personnel is able to select the correct ballast for repair.

In a third aspect there is provided a method of providing maintenance information from ballast type detection data received from a lighting device according to the present disclosure and/or from such a lighting device installed in a lighting system as disclosed above, the method comprising the steps of:

receiving the ballast type detection data, comparing the received ballast type detection data with ballast type detection data stored in a ballast type data base, identifying malfunctioning of a ballast based on the comparison, and providing maintenance information including a type of ballast in case of malfunctioning of the ballast.

The steps above may be performed, for example, by the maintenance unit of a lighting system and/or by the ballast type detection circuit of a lighting device.

Accordingly, with the present disclosure, a cost efficient maintenance and high reliability retrofit lighting is achieved, in particular for industrial lighting systems, providing for an efficient and quick repair in case of malfunctioning of a ballast, because service personnel is informed in advance of the type of ballast installed in a particular luminaire, and by which the costs of spare parts may be kept as low as possible, as the types of ballast in service are known.

These and other aspects of the invention will be apparent from and elucidated with reference to the embodiment described hereinafter.

DETAILED DESCRIPTION

Figure 1:
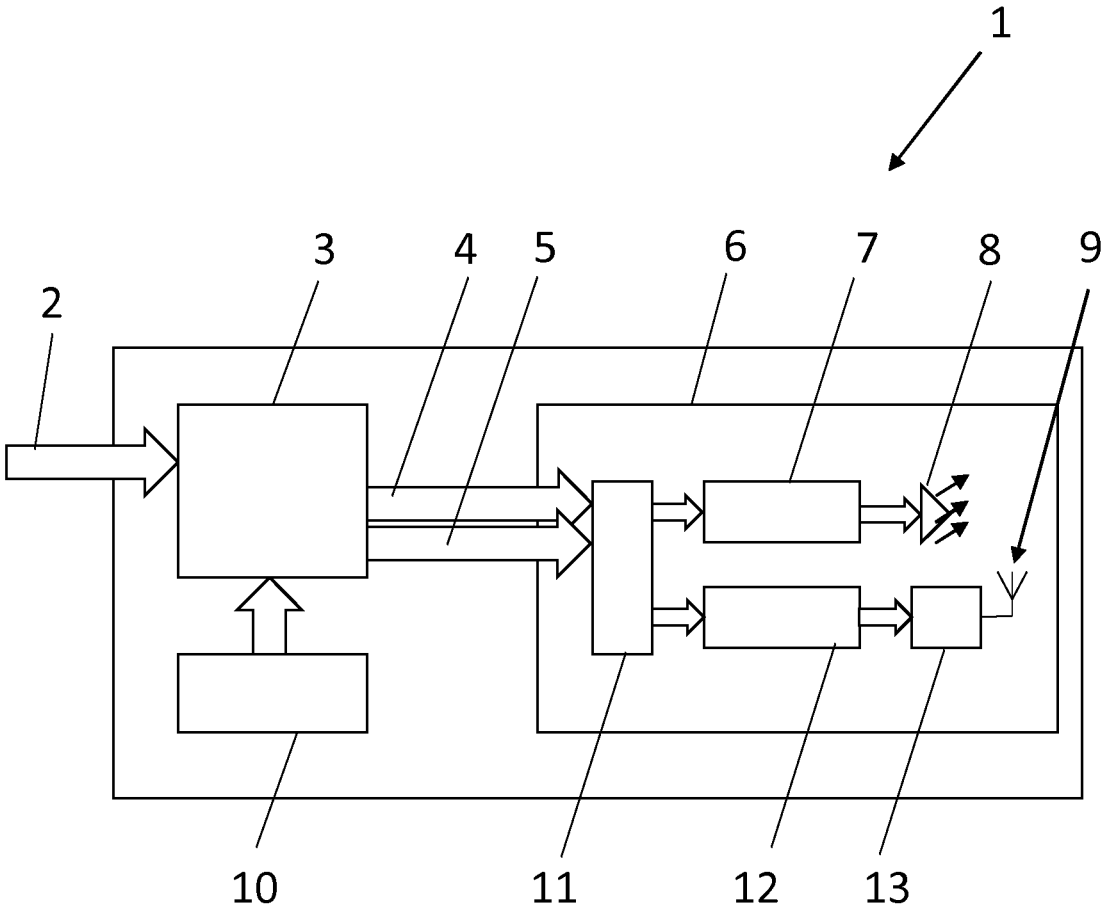
FIG. 1 shows an example of a lighting fixture comprising a lighting device in accordance with an embodiment of the present disclosure.

Reference numeral 1 in FIG. 1 designates a lighting fixture comprising a lighting device 6 in accordance with an embodiment of the present disclosure. The lighting device 6 has, for example, a retrofit Light Emitting Diode, LED, tube housing for replacing a traditional fluorescent tube light, TL. The retrofit LED tube is designed to fit in in conventional armatures for fluorescent tubes, for example fluorescent tubes suitable for lamp types designated T5, T8, T12 or anything alike. In order to fit in these conventional armatures, the lighting device comprises a connector 11 having, for example, conducting pens for electrically connecting, and supporting, the lighting device in a conventional armature or lighting fixture 1. In the case of an tube LED, TLED, most often four wires, two on each end of the tube to support filaments that are present in legacy fluorescent tubes.

The lighting device 6 comprises a solid-state lighting source such as a Light Emitting Diode, LED, module 8 for emitting light. The LED module 8 may comprise a plurality of series and parallel connected LEDs. Those skilled in the art will appreciate that in practical embodiments the LEDs are evenly distributed and spaced apart across the length of the lighting device 6, i.e. a LED tube, to provide for an evenly as possible lighting by the lighting device 6 over its entire length. The present disclosure is not limited to any specific type of LED, nor to any colour LEDs. Typically, white coloured LEDs are used.

The LEDs of the LED module 8 are powered through an electronic driver circuit 7, for example a controllable electronic rectifier circuit or switching mode power supply, included in the tube housing. A rectifier typically has an input and an output, such that in use the rectifier is arranged to receive an AC supply voltage at its input, from a connected electrical ballast 3, to convert the AC supply voltage to a DC voltage, and to provide the DC voltage at its output to the LED module 8.

The driver circuit 7 is operatively connected between the connector 11 and the LED module 8 and is arranged for controlling supply of power to the LED module 8. The connector 11 comprises means for fitting and supporting the lighting device 6 into sockets of the lighting fixture 1.

Further, an electronic ballast type detection circuit 12 is provided in the tube housing of the lighting device 6, which ballast type detection circuit 12 is operatively connected to the connector 11 and is arranged for providing ballast type detection data from signals supplied by the ballast 3 to the connector 11.

The ballast 3 is of a certain type, e.g. a particular brand, a series or parallel ballasts, an IC based ballast or self resonation based, etc. each having its own specific output signal characteristics. Accordingly, data for determining the type of ballast may be obtained from monitoring the output signal of the ballast.

Such ballast type detection data may be obtained, for example, from power supply frequency monitoring of a self-resonating High Frequency, HF, or Radio Frequency, RF, electronic ballast and/or a power supply resonant rank probing monitoring of a self-resonating HF/RF electronic ballast and/or control parameter monitoring of an integrated circuit, IC, resonance controlled HF/RF electronic ballast and/or power supply voltage and current monitoring at the connector 11 of the lighting device 6, generally indicated by reference numeral 4.

Electronic ballasts control the electric power provided to a fluorescent light source by electronic control circuitry. An electronic ballast, sometimes also referred to as control gear, is typically arranged to limit the current which flows in an electrical load, i.e. a lamp, such that the current is basically kept at a level that prevents the lamp from burning out. These type of ballasts may operate in parallel or in a series mode. Preferably, a series mode is used because in such case, the failure of a single lamp does not disrupt the working of all other lamps. Such a ballast typically operates at a frequency above 20 kHz, and substantially eliminates the flicker common in old-fashion fluorescent lighting.

Another type of ballast is an (electro)magnetic ballast which employs a core and coil transformers to operate lamps. These types of ballasts are arranged to control the electric current by an inductive magnetic field. Although these types of ballasts are the simplest, they are characterized by higher robustness.

In the case of a TLED, for example, the current provided to the filaments of a legacy fluorescent tube light may be used to deduce information with respect to the actual ballast in the lighting fixture 21.

Part of the ballast type detection data may be directly obtainable by the ballast type detection circuit 12 while an other part may be received indirectly, e.g. extracted from the driver circuit 7. As an example, the frequency of the supply signal is easily detectable directly, while the fluctuation of the voltage amplitude may cause a driver circuit 7 control loop to counteract, such that the control loop signals of the driver circuit 7 will be impacted by the fluctuation. Hence, these signals may provide ballast type detection data or information in an indirect manner.

It is noted that, in accordance with the present disclosure, the type of ballast may also be disclosed to the lighting device 6 by auxiliary data. That is, a ballast type unit or database 10 may be provided in the lighting fixture 1, which ballast type unit or database 10 is arranged to provide additional or auxiliary information 5 with respect to the type of ballast, for example data directly identifying the type of ballast or support information from data sheets, etc. This information is thus provided in parallel or supportive to the ballast type detection data determined from the power and/or control signals supplied by/to the ballast 3.

The auxiliary data or information 5 may be provided to the lighting device 6, i.e. the ballast type detection circuit 12, through the electrical wiring, i.e. generally a hot or phase wire and a return or null wire.

The ballast type detection circuit 12 may be arranged to directly establish a type of ballast 3 from the ballast type detection data whether or not supported by auxiliary data. It will be appreciated that in such a case the driver 7 may be controlled by or receive the information of the ballast type from the ballast type detection circuit 12, to properly control the power supplied to the LED module 8.

The lighting device 6 further comprises a communication circuit 13, included in the housing of the lighting device, which communication circuit 13 is operatively connected to the ballast type detection circuit 12 and is arranged for exchanging ballast type detection data.

Conveniently, the data are exchanged wirelessly using an antenna 9. The wirelessly exchanged ballast type detection data may comprise any of a radio or radio frequency, RF, signal or an infra-red, IR, signal, for example, operated in accordance with a standardized or proprietary signalling protocol. In practice, wireless radio transmission technologies available for use with the invention are, inter alia, ZigBee™, Bluetooth™, WiFi based protocols, or any Mesh type of wireless network.

The lighting device 6 in accordance with the present disclosure may, for example, be used as a type of test tube to indicate, to a user, which ballast is present in the lighting fixture 1. That is, a lighting device 6 may be inserted in the lighting fixture 1 to determine which ballast is present in the lighting fixture 1. As explained above, the lighting device 6 may detect the actual type of ballast present in the lighting fixture 1 and may exchange this information with the outside world.

Accordingly, in a lighting system, such as an industrial lighting system, for example, not all fluorescent tubes need to be replaced by a lighting device 6, but once the type of ballast used in the system has been established, the lighting fixtures of the system may be retrofitted by lighting devices particularly adapted to the particular ballast. Retrofitting may, of course, also be performed each time a fluorescent tube malfunctions and breaks down.

The communication circuit 13 advantageously may be arranged to communicate the type of the ballast to a maintenance unit. Which maintenance unit is accessible for a user, such that a user is able to determine what type of ballast is provided in the lighting fixture 1. The user can use this information to determine in advance which tube, i.e. retrofit LED tube, has to be used to replace the broken fluorescent tube, for example. As such, the lighting device 6 in accordance with the present disclosure is used as a tool for determining, and indicating, which type of ballast is present in a lighting fixture 1, for effectively replacing same by a proper retrofit LED tube.

In accordance with the present disclosure, the housing of the lighting device 6 is arranged to accommodate the driver circuit 7, the ballast type detection circuit 12, the communication circuit 13 and antenna 9, the interface 11 and the LED module 8. The housing may be a light transmissive housing or a partly light transmissive housing, configured as a retrofit tube type, for example.

Figure 2:
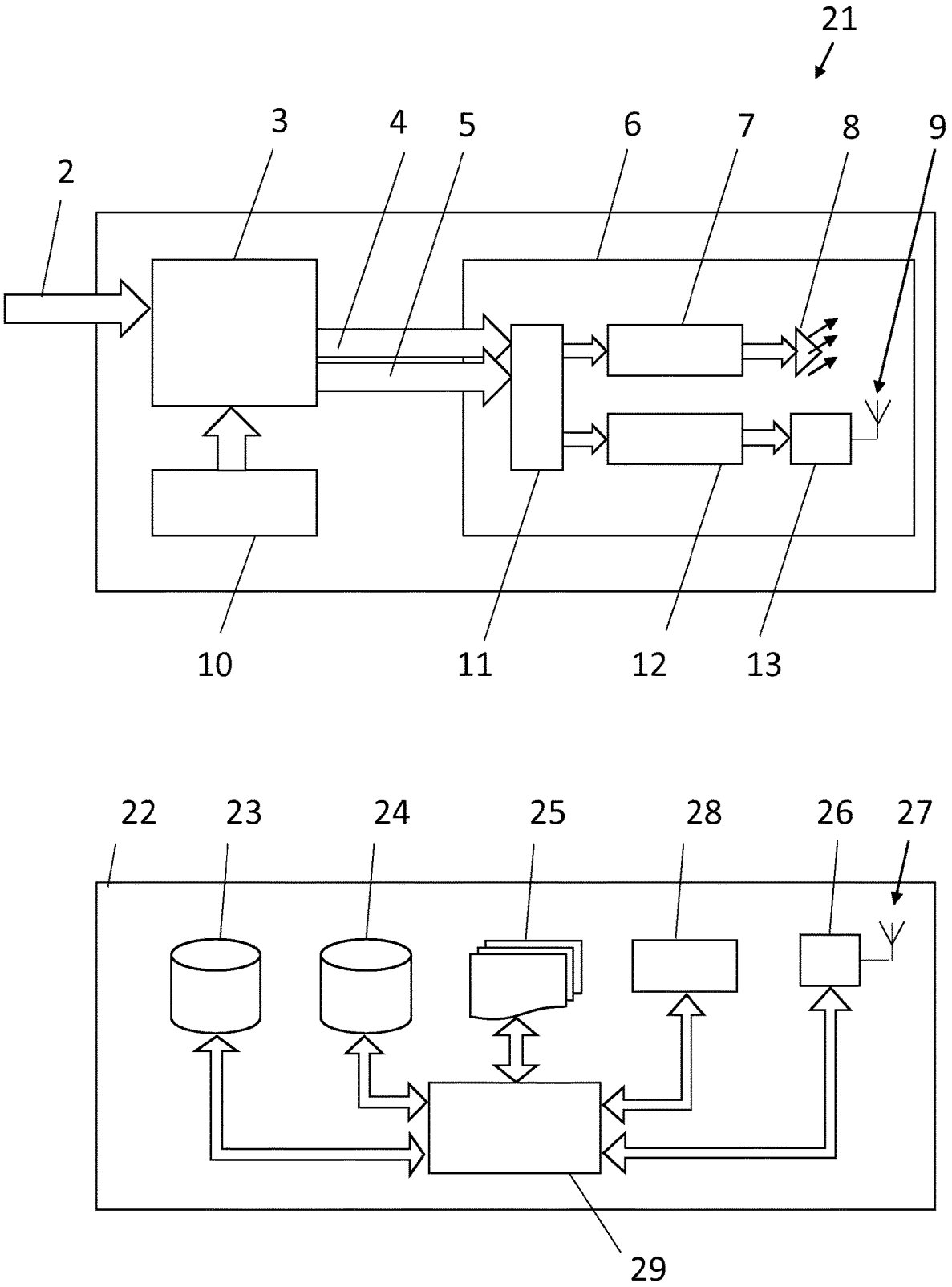
FIG. 2 shows an example of a lighting system in accordance with an embodiment of the present disclosure.

FIG. 2 shows an example of a lighting system 21 in accordance with an embodiment of the present invention. The lighting system comprises at least one lighting device 6, for example as disclosed in FIG. 1, which lighting device 1 is provided, or is to be provided, in a lighting fixture.

Further a lighting control system 22 is provided comprising a communication unit 26 and an antenna 27 connected to the communication unit 26. The communication unit 26 is arranged to operatively, wirelessly communicate with the communication circuit 13 present in the at least one lighting device 6. When the lighting system 21 comprises a plurality of lighting devices 6, each of these lighting devices 6 are then able to communicate with the communication unit 26 and individually addressable, for example.

For example, a one to one communication link between a particular communication circuit 13 and the communication unit 26 may be established, or some sort of hopping scheme, i.e. mesh network, may be utilized for the communication. For example, intermediate lighting devices 6 may be used as additional hops for communication between a particular communication circuit of a lighting device and the communication unit 26.

The lighting control system 22, such as a building lighting management system, BMS, further comprises a maintenance unit 25 arranged for receiving the ballast type detection data of the at least one lighting device 6 provided on at least one of an event drive and time driven basis, for analysing malfunctioning of a ballast based on the received ballast type detection data.

To this end, the maintenance unit 25 may interface with a ballast data base 24 as well as with a lamp data base 23 to determine which ballast is present in the lighting fixture. Further the data bases 23, 24 may be utilized to determine, from the ballast type detection data received, whether a detected ballast 3 is actually malfunctioning.

The lighting control system 22 may further be in direct communication with an "app" or anything alike running on a smart device, like a mobile phone or a tablet. The lighting control system 22 is then able to communicate information with respect to the ballast in the lighting fixture directly to a user using the app. This is beneficial as in this case, the end user, for example maintenance personnel, is made aware of the type of ballast present in the lighting fixture. Based on this information, the maintenance personnel can select in advance a suitable retrofit LED tube to replace a malfunctioning tube present in the lighting fixture. The chosen retrofit LED tube is, for example, optimized and better suited for use with the detected type of ballast.

It will be appreciated that data stored in an or both of the data bases 23, 24 may be used by the ballast type detection circuit 12 to determine the type of ballast. As an alternative or in addition to the ballast type detection circuit 12, the lighting control system 22 may comprise a ballast type detection unit 28, operatively connected to the ballast type data base 24 and/or the lamp data base 23, and arranged for establishing a type of ballast of the at least one lighting device 6 from the exchanged ballast type detection data and/or the auxiliary data.

The amount of support of the data bases 23, 24 has a direct impact on the intelligence required in the ballast type detection circuit 12 of a lighting device 6 and the amount of data that has to be communicated through the communication link between the communication circuit 13 and the communication unit 26, as elucidated in the summary part above.

The databases 23, 24, the maintenance unit 25, the ballast type detection unit 28, and the communication unit 26 may be operated under control of a processor or computer or server 29, either a local computer and/or a remote, cloud based computer, for example.

Figure 3:
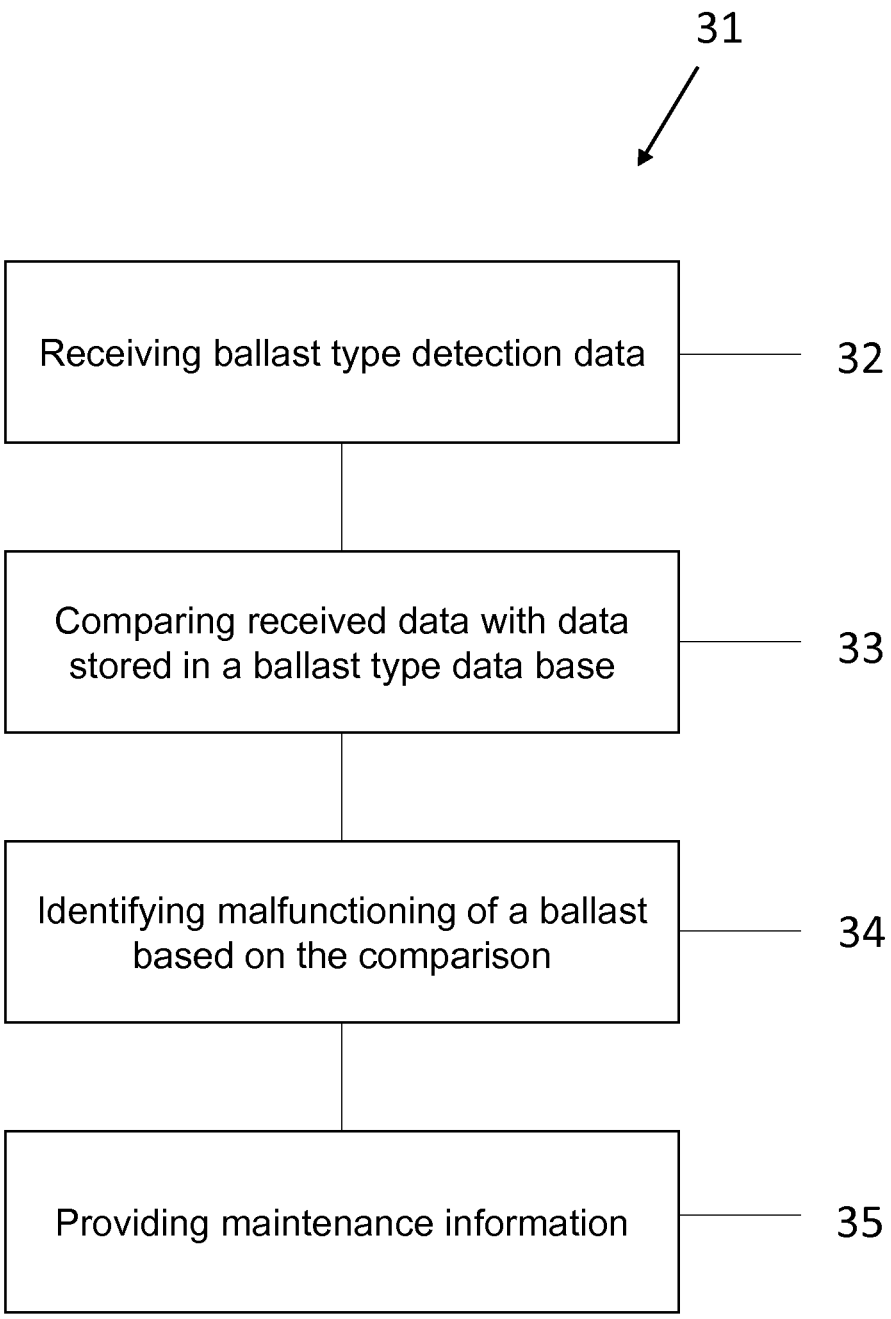
FIG. 3 shows an flowchart of a method of providing maintenance information in accordance with the present disclosure.

FIG. 3 shows a simplified flowchart 31 of a method of providing maintenance information in accordance with the present disclosure.

The method 31 is directed for providing maintenance information from ballast type detection data received from a lighting device 6 in accordance with any of the examples disclosed above, or from a lighting device 6 in a lighting system 21 according to any of the examples disclosed above.

The method 31 comprising the steps of receiving 32 the ballast type detection data, for example from a communication circuit 13 present in a lighting device 6 and/or a communication unit 26 of the lighting management system 22. The ballast type detection data may comprise frequency measurements, magnitude(s) of current and voltage levels, auxiliary data, variation in current and voltage levels, etc. That is, any information which could be used to deduce the type of ballast may be suitable.

In a next step, the method comprises comparing 32 the received ballast type detection data with ballast type detection data stored in a ballast type data base, such as the data base 24. This step is directed to finding the best match for the received ballast type detection data. As such, the received data are, for example, correlated with the ballast type detection data present in the data base 24 to find out which data in the data base is the best match for the received detection data.

In a subsequent step, the method comprises the step of identifying malfunctioning 33 of a ballast based on the comparison result of step 33. Based on the matching process as described above, it can also be determined whether a particular ballast is malfunctioning, or at least not working properly. In case the received data fully matches particular data present in the data base, it may be assumed that the ballast is working properly. However, if the best matched data in the data base with the received data still differs at certain aspects, it may be assumed that the ballast is not working properly.

This identification step may be used by providing 34 maintenance information including a type of ballast in case of malfunctioning of the ballast. The maintenance information may be provided on a smart phone or a tablet of a maintenance personnel. Alternatively, or additionally, the information may be provided to a maintenance server, such that the information can be stored in a central location.

It will be appreciated that the ballast type detection data or ballast type data gathered by the lighting device in general provide valuable information that can be used for asset management, inventory control and service management, in particular in industrial lighting systems and BMS.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope thereof.

The invention claimed is:

1. A lighting device comprising a connector arranged for being installed in a lighting fixture comprising a ballast for powering said lighting device, said lighting device comprising:

a light emitting diode module;

a driver circuit, operatively connected between said connector and said light emitting diode module, arranged for controlling supply of power to said light emitting diode module;

a ballast type detection circuit, operatively connected to said connector, arranged for determining ballast type detection data from power signals supplied by said ballast to said connector, and a communication circuit, operatively connected to said ballast type detection circuit, arranged for exchanging said ballast type detection data;

wherein said ballast type detection circuit is arranged for establishing a type of ballast based on said ballast type detection data.

2. The lighting device according to claim 1, wherein said communication circuit is arranged for exchanging said ballast type detection data with a ballast type data base of a lighting system.

3. The lighting device according to claim 1, wherein said ballast type detection circuit and said communication circuit are arranged for exchanging auxiliary data in support of said ballast type detection data.

4. The lighting device according to claim 3, wherein said communication circuit is arranged for wirelessly exchanging at least one of said ballast type detection data and said auxiliary data.

5. The lighting device according to claim 3, wherein said ballast type detection circuit is arranged for establishing a type of ballast from said ballast type detection data and said auxiliary data.

6. The lighting device according to claim 1, wherein said ballast type detection circuit is arranged for determining ballast type detection data from at least one of:

power supply frequency monitoring of a self-resonating radio frequency electronic ballast;

power supply resonant tank probing monitoring of a self-resonating radio frequency electronic ballast;

control parameter monitoring of a control circuit of a resonance controlled radio frequency electronic ballast, and power supply voltage and current monitoring at the connector of said lighting device.

7. The lighting device according to claim 1, wherein said ballast type detection circuit and said communication circuit are arranged for exchanging said ballast type detection data on at least one of an event driven and time driven basis.

8. A lighting system, comprising at least one lighting device in accordance with claim 1, a communication unit arranged for exchanging ballast type detection data with a communication circuit of said at least one lighting device, and a ballast type data base of said lighting system.

9. The lighting system according to claim 8, wherein said ballast type data base comprises auxiliary data in support of said ballast type detection data.

10. The lighting system according to claim 9, wherein said communication module is arranged for exchanging said auxiliary data with said communication circuit of said at least one lighting device.

11. The lighting system according to claim 9, comprising a ballast type detection unit, operatively connected to said ballast type data base, and arranged for establishing a type of ballast of said at least one lighting device from said exchanged ballast type detection data and said auxiliary data.

12. The lighting system according to claim 8, comprising a maintenance unit, arranged for receiving ballast type detection data of said at least one lighting device provided on at least one of an event driven and time driven basis, for analyzing malfunctioning of a ballast based on said received ballast type detection data.

13. A method of providing maintenance information from ballast type detection data received from a lighting device in accordance with claim 1 or from a lighting device in a lighting system, said method comprising the steps of:

receiving said ballast type detection data, comparing said received ballast type detection data with ballast type detection data stored in a ballast type data base, identifying malfunctioning of a ballast based on said comparison, and providing maintenance information including a type of ballast in case of malfunctioning of said ballast.

14. The method according to claim 13, wherein said steps are performed by at least one of a maintenance unit of a lighting system and a said ballast type detection circuit of a lighting device.

* * * * *